US006119268A

United States Patent [19]

McCauslin

[11] Patent Number: 6,119,268

[45] Date of Patent: Sep. 19, 2000

[54] DISPOSABLE CHEMICAL CAPES

[75] Inventor: Debora S. McCauslin, 715 Bryant St., Niles, Mich. 49120

[73] Assignee: Debora S. McCauslin, Niles, Mich.

[21] Appl. No.: 09/030,815

[22] Filed: Feb. 26, 1998

[51] Int. Cl.[7] ..... A41D 27/12; A41D 3/08

[52] U.S. Cl. ..... 2/50; 2/52

[58] Field of Search ..... 2/50, 49.1, 48, 2/51, 52, 88, 49.3, 49.4

[56] References Cited

U.S. PATENT DOCUMENTS

| | | | |
|---|---|---|---|
| 2,016,079 | 10/1935 | Deuel et al. | 2/50 |
| 2,080,107 | 5/1937 | Brandstein | 2/50 |
| 2,865,023 | 12/1958 | Anderson | 2/50 |
| 3,031,676 | 5/1962 | Larson | 2/50 |
| 3,299,440 | 1/1967 | Grable | 2/49.1 |
| 3,999,221 | 12/1976 | Hannigan | 2/49.1 |
| 4,186,443 | 2/1980 | Britzman | 2/49.1 |
| 4,646,364 | 3/1987 | O'Larey | 2/50 |
| 5,644,793 | 7/1997 | Lahaussois et al. | 2/49.1 |
| 5,740,552 | 4/1998 | Smith | 2/52 |
| 5,809,568 | 9/1998 | Morris-Jones | 2/52 |
| 5,930,837 | 8/1999 | Anvar | 2/49.1 |
| 5,963,986 | 10/1999 | Deppen | 2/50 |

FOREIGN PATENT DOCUMENTS

| | | | |
|---|---|---|---|
| 2662923 | 12/1991 | France | 2/50 |
| 456037 | 11/1936 | United Kingdom | 2/50 |
| 2220557 | 1/1990 | United Kingdom | 2/50 |

*Primary Examiner*—Amy B. Vanatta

[57] ABSTRACT

A disposable chemical cape to be used in the beauty industry to protect the customer and their clothing from any liquid dripping or running of the product being used to perform a chemical service such as a color or perm. The straps of the cape tie around the neck of the customer to hold the cape in place. The cape covers the complete portion of the upper body including the lap area and has shoulder guards which overlap in back to cover the shoulders, arms, and upper back of the customer receiving the service. This ensures the salon customer of complete sanitation in the wearing of each individual cape.

1 Claim, 3 Drawing Sheets

DISPOSABLE CHEMICAL CAPES

BACKGROUND OF THE INVENTION

This invention relates to the field of Cosmetology and Barbering to ensure the customer of complete sanitation by the draping of a disposable chemical cape.

At present, the only thing available to the open market is a nondisposable chemical cape which must be sanitized by washing after each wear.

BRIEF SUMMARY OF THE INVENTION

This invention, the disposable chemical cape, is composed of a waterproof material. It is intended to be worn by a customer to insure complete sanitation and to shield them from any liquid treatment, such as perms and color.

The plastic cape is draped over the client's shoulders and tied around the neck to secure it into place.

This invention aids in such ways that the salon never has to spend time laundering the capes. This in turn gives way to never putting a tattered or torn cape on a patron. The customer never has to worry about sanitation because the capes are disposable. By not having to worry about any of the above, these capes become very cost effective to the professional salon.

BRIEF DISCRIPTION OF THE SEVERAL VIEWS OF THE DRAWINGS

DETAILED DESCRIPTION OF THE INVENTION

Figure 1:
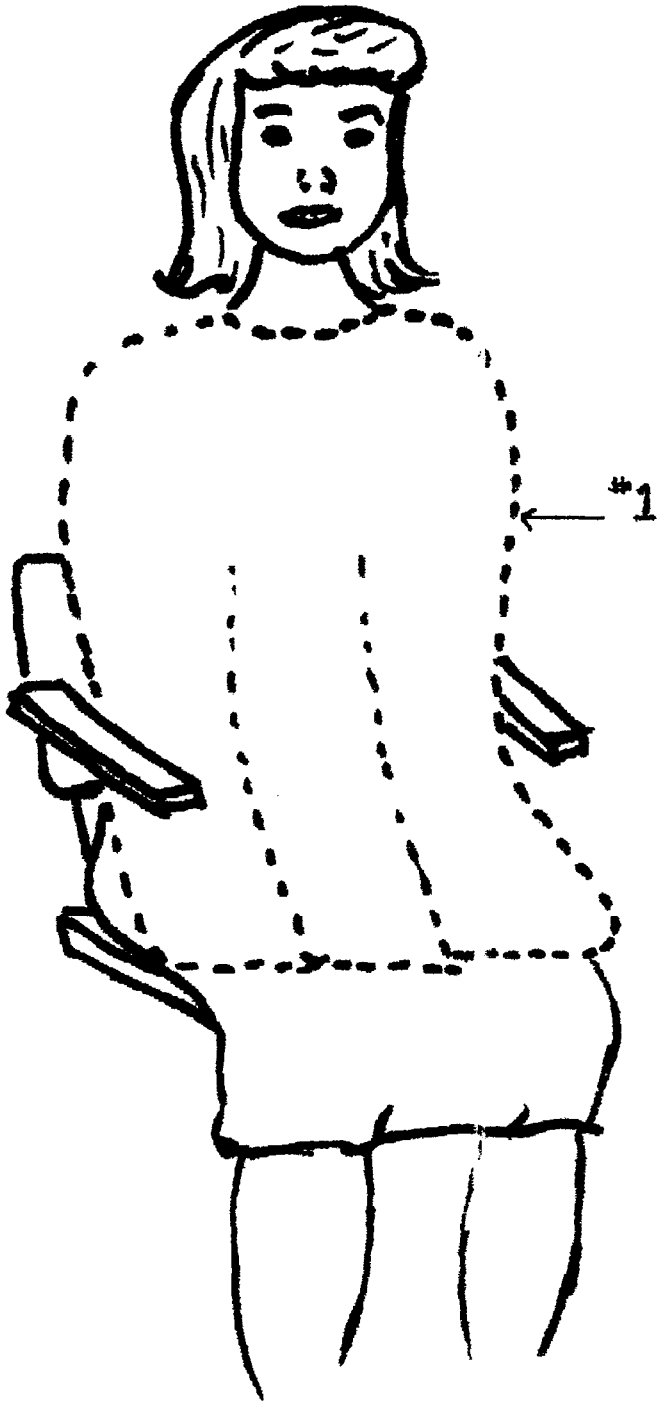
FIG. 1 is an overall view of a customer draped with the waterproof chemical cape.

FIG. 1 shows the disposable chemical cape, generally designated 1, which completely drapes the customer wearing the disposable chemical cape, protecting all areas that may be affected by chemical drip.

Figure 2:
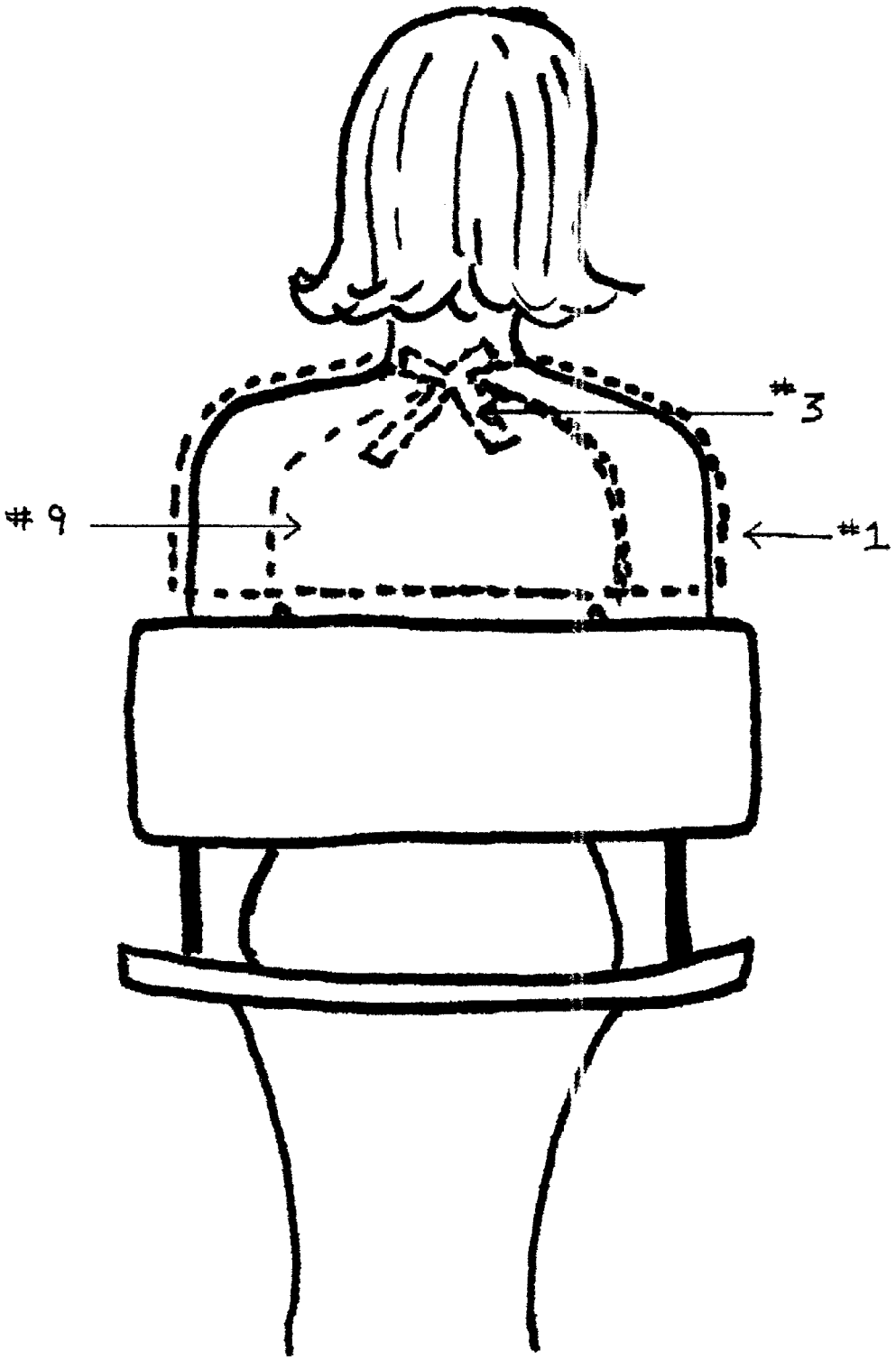
FIG. 2 shows how the perforated cut out forms the neckline and drapes around the back of the customer.

FIG. 2 shows the back side of the chemical cape pulled together by tie straps 3, creating an overlapping effect by the shoulder guards 9, thus creating a complete protective covering for the customer receiving the chemical service.

Figure 3:
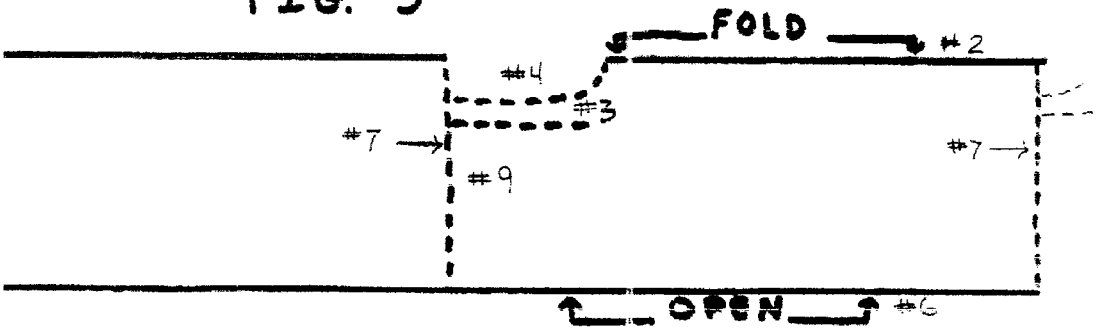
FIG. 3 shows the presentation of the manufactured product on a fold.

FIG. 3 illustrates one way of manufacturing the product by placing the plastic garment on a fold 2, thus creating an open edge on the opposite side 6. FIG. 3 shows the neck ties 3, the neck opening 4, and shoulder guards 9, in perforation, for easy access to these elements. FIG. 3 illustrates the repeat pattern with perforations 7, making it easy to separate one cape from the other.

Figure 4:
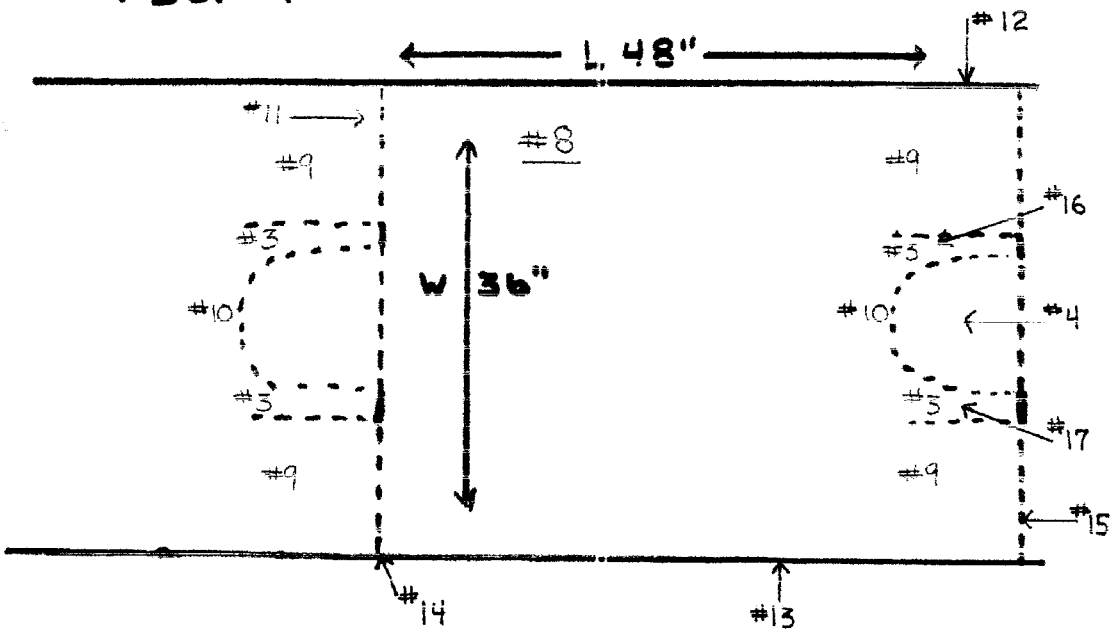
FIG. 4 shows the presentation of the manufactured product on a flat plane.

FIG. 4 shows the preferred way of manufacturing the product on a flat plane showing all elements of the design.

The cape is made of a rectangular sheet of material 8, preferably measuring about 36 inches in width and about 48 inches in length. The sheet has a first side edge 12 and an opposite second side edge 13, a lower edge 14 and an upper edge 15. A first perforated tear line 10 extends in a U-shape to form the neck hole 4. A second perforated tear line 16 and a third perforated tear line 17 extend downward from the upper edge 15. When the second and third tear lines 16 and 17 are torn, tie straps 3 and shoulder guards 9 are formed. A repeat pattern of the cape is separable from the adjacent pattern by perforated line 11. When the perforated lines are torn, the waterproof cape forms a structure which protects the clothing of the customer and can be discarded after each use to ensure the sanitation of the garment.

What is claimed is:

1. A disposable chemical cape to be worn by a customer receiving a chemical service in the beauty industry, comprising:

a generally rectangular sheet of disposable waterproof material, having opposite first and second side edges, a lower edge, and an upper edge;

a first perforated tear line extending from a first point on said upper edge along a generally U-shaped path back to a second point on said upper edge spaced from said first point to define a removable portion of said sheet for forming a neck hole;

a second perforated tear line spaced from said first tear line and extending from a third point on said upper edge in a direction perpendicular to said upper edge, said third point being between said first point and said first side edge;

a third perforated tear line spaced from said first and second tear lines and extending from a fourth point on said upper edge in a direction perpendicular to said upper edge, said fourth point being between said second point and said second side edge;

wherein said first and second tear lines, when torn, form a first tie strap therebetween and said first and third tear lines, when torn, form a second tie strap therebetween, said first and second tie straps being fastenable behind a wearer's neck when said cape is worn;

said cape having a front portion between a bottom of said neck hole and said lower edge, said front portion covering the arms and front of the wearer to protect from harmful spills;

said cape further including first and second shoulder guards, said first shoulder guard being formed between said first side edge and said second tear line, and said second shoulder guard being formed between said second side edge and said third tear line, said shoulder guards covering the wearer's shoulders and overlapping on the wearer's back when the cape is worn so as to protect the wearer's shoulder and back area from harmful spills.

* * * * *